US008701919B2

(12) United States Patent
Messier

(10) Patent No.: US 8,701,919 B2
(45) Date of Patent: Apr. 22, 2014

(54) PLASTIC CONTAINER

(75) Inventor: Patrick Messier, Montréal (CA)

(73) Assignee: Cascades Canada ULC, Montreal (CA)

( * ) Notice: Subject to any disclaimer, the term of this patent is extended or adjusted under 35 U.S.C. 154(b) by 2 days.

(21) Appl. No.: 13/810,367

(22) PCT Filed: Jul. 13, 2011

(86) PCT No.: PCT/CA2011/050430

§ 371 (c)(1),
(2), (4) Date: Mar. 20, 2013

(87) PCT Pub. No.: WO2012/006739

PCT Pub. Date: Jan. 19, 2012

(65) Prior Publication Data

US 2013/0168394 A1 Jul. 4, 2013

Related U.S. Application Data

(60) Provisional application No. 61/364,846, filed on Jul. 16, 2010.

(51) Int. Cl.
*B65D 41/32* (2006.01)
*B65D 41/48* (2006.01)

(52) U.S. Cl.
USPC ..... 220/266; 220/270; 220/276; 220/839

(58) Field of Classification Search
USPC ..... 220/266, 276, 270, 839
See application file for complete search history.

(56) References Cited

U.S. PATENT DOCUMENTS

| | | | |
|---|---|---|---|
| 4,244,470 | A | 1/1981 | Burnham |
| 4,334,631 | A | 6/1982 | Ballester |
| 4,378,895 | A | 4/1983 | Woinarski |
| 4,449,641 | A | 5/1984 | Jorgensen et al. |
| 4,474,305 | A | 10/1984 | Marco |
| 4,524,882 | A | 6/1985 | Buc |
| 4,602,719 | A | 7/1986 | Borst |
| 4,660,735 | A | 4/1987 | Peschardt et al. |

(Continued)

FOREIGN PATENT DOCUMENTS

| | | |
|---|---|---|
| CA | 1114756 | 12/1981 |
| CA | 2067951 | 11/1992 |

(Continued)

*Primary Examiner* — Mickey Yu
*Assistant Examiner* — Niki Eloshway
(74) *Attorney, Agent, or Firm* — Sutherland Asbill & Brennan LLP

(57) ABSTRACT

The plastic container has a lid and a receptacle, the receptacle and lid having corresponding engagement portions matingly shaped for the lid and receptacle to be maintained in a closed configuration by a resilient effect. In one embodiment, the lid has a handle lip extending vertically downwardly from a horizontal edge of the lid, the handle lip being shaped to allow overcoming the resilient effect when manually pulled upwardly; the receptacle having a barrier strip covering the handle lip and preventing manual pulling access thereto, but being tearable to allow its manual removal. In an other embodiment, the receptacle has an upwardly protruding receptacle rib providing sealing abutment support to the lid closure, a gutter surrounding the receptacle rib, and the receptacle wall portion has an engagement portion matingly shaped to resiliently receive the outwardly protruding rib of the lid and inclined so as to face both inwardly and downwardly.

19 Claims, 4 Drawing Sheets

(56) References Cited

U.S. PATENT DOCUMENTS

| | | | | | |
|---|---|---|---|---|---|
| 4,836,407 | A | | 6/1989 | Bruce et al. | |
| 4,854,472 | A | * | 8/1989 | Semersky | 220/783 |
| 4,893,452 | A | | 1/1990 | Bruce et al. | |
| 4,998,622 | A | * | 3/1991 | Drack | 206/519 |
| 5,090,180 | A | | 2/1992 | Sörensen | |
| D332,917 | S | | 2/1993 | McDevitt et al. | |
| D336,850 | S | | 6/1993 | Guillin | |
| 5,237,796 | A | | 8/1993 | Bonkowski | |
| 5,238,632 | A | | 8/1993 | Watters et al. | |
| 5,249,694 | A | * | 10/1993 | Nelson | 220/276 |
| 5,300,748 | A | | 4/1994 | Colombo | |
| 5,366,104 | A | | 11/1994 | Armstrong | |
| D354,435 | S | | 1/1995 | Krupa | |
| 5,398,836 | A | | 3/1995 | Luch et al. | |
| 5,421,473 | A | | 6/1995 | McCrossen | |
| 5,427,266 | A | | 6/1995 | Yun | |
| 5,507,406 | A | | 4/1996 | Urciuoli et al. | |
| 5,573,134 | A | * | 11/1996 | Chenault et al. | 220/276 |
| 5,785,203 | A | * | 7/1998 | Arshinoff et al. | 220/783 |
| 5,788,105 | A | | 8/1998 | Foos | |
| 6,033,748 | A | | 3/2000 | Dunning et al. | |
| 6,056,141 | A | | 5/2000 | Navarini et al. | |
| 6,116,440 | A | | 9/2000 | Zaksenberg et al. | |
| 6,170,696 | B1 | | 1/2001 | Tucker et al. | |
| 6,609,627 | B1 | | 8/2003 | Clarke | |
| 6,609,633 | B1 | | 8/2003 | Dyble et al. | |
| 6,719,139 | B1 | | 4/2004 | Foos et al. | |
| D490,278 | S | | 5/2004 | Welsh | |
| D503,336 | S | | 3/2005 | Tucker et al. | |
| 6,868,654 | B2 | | 3/2005 | Douglas | |
| 6,878,336 | B1 | | 4/2005 | Browning et al. | |
| 6,893,603 | B2 | | 5/2005 | Rohde et al. | |
| 6,902,818 | B2 | | 6/2005 | Murschall et al. | |
| D524,645 | S | | 7/2006 | LaMasney | |
| 7,097,066 | B2 | | 8/2006 | Tucker et al. | |
| 7,219,484 | B2 | | 5/2007 | Duffield et al. | |
| 7,246,714 | B2 | | 7/2007 | Garg et al. | |
| 7,255,552 | B2 | | 8/2007 | Michelon et al. | |
| 7,597,206 | B2 | | 10/2009 | Atkins et al. | |
| 8,127,961 | B2 | * | 3/2012 | Vovan | 220/270 |
| 8,157,123 | B2 | * | 4/2012 | Tucker et al. | 220/789 |
| 2001/0008240 | A1 | | 7/2001 | Herrin | |
| 2005/0040218 | A1 | | 2/2005 | Hinchey et al. | |
| 2005/0133508 | A1 | | 6/2005 | Landis et al. | |
| 2005/0161455 | A1 | | 7/2005 | Studee | |
| 2005/0170032 | A1 | | 8/2005 | Moretti | |
| 2005/0189353 | A1 | | 9/2005 | Padovani | |
| 2005/0194282 | A1 | | 9/2005 | Kraimer et al. | |
| 2005/0247708 | A1 | | 11/2005 | Golden | |
| 2006/0006178 | A1 | | 1/2006 | Foldesi, Sr. et al. | |
| 2006/0062874 | A1 | | 3/2006 | Sinichko et al. | |
| 2006/0175334 | A1 | | 8/2006 | Schwarz | |
| 2006/0266672 | A1 | | 11/2006 | Young | |
| 2007/0012710 | A1 | | 1/2007 | Vovan | |
| 2007/0026250 | A1 | | 2/2007 | Hofmeister et al. | |
| 2007/0045317 | A1 | | 3/2007 | Rosender et al. | |
| 2007/0196541 | A1 | | 8/2007 | Vovan et al. | |
| 2007/0252307 | A1 | | 11/2007 | Borst | |
| 2008/0006632 | A1 | | 1/2008 | Vovan | |
| 2008/0011637 | A1 | | 1/2008 | Young et al. | |
| 2008/0023875 | A1 | | 1/2008 | Jammet et al. | |
| 2008/0044603 | A1 | | 2/2008 | Hutchinson et al. | |
| 2008/0087669 | A2 | | 4/2008 | Boback et al. | |
| 2008/0116098 | A1 | | 5/2008 | Marooflan et al. | |
| 2008/0118609 | A1 | | 5/2008 | Harlfinger | |
| 2008/0156861 | A1 | | 7/2008 | Sierra-Gomez et al. | |
| 2008/0217337 | A1 | | 9/2008 | Rault et al. | |
| 2008/0258329 | A1 | | 10/2008 | Polk et al. | |
| 2008/0314771 | A1 | | 12/2008 | Barbalho et al. | |
| 2009/0039556 | A1 | | 2/2009 | Sawada et al. | |
| 2009/0120937 | A1 | | 5/2009 | Vovan | |
| 2009/0274920 | A1 | | 11/2009 | Li et al. | |

FOREIGN PATENT DOCUMENTS

| | | |
|---|---|---|
| CA | 2118233 | 11/1993 |
| CA | 2394829 | 7/2001 |
| CA | 2396943 | 7/2001 |
| CA | 2468725 | 6/2003 |
| CA | 2482018 | 3/2005 |
| CA | 2656641 | 1/2008 |
| CA | 2676604 | 2/2010 |
| EP | 0383677 | 8/1990 |
| EP | 0628492 | 12/1994 |
| EP | 1544129 | 6/2005 |
| EP | 1930253 | 6/2008 |
| EP | 2082974 | 7/2009 |
| GB | 2086862 | 5/1982 |
| GB | 2219284 | 12/1989 |
| GB | 2298415 | 9/1996 |
| WO | 0021849 | 4/2000 |
| WO | 02087852 | 11/2002 |
| WO | 2005056414 | 6/2005 |
| WO | 2006119538 | 11/2006 |
| WO | 2008020238 | 2/2008 |
| WO | 2008156921 | 12/2008 |

* cited by examiner

PLASTIC CONTAINER

CROSS-REFERENCE TO RELATED APPLICATIONS

This application claims priority of U.S. provisional application 61/364,846 filed Jul. 16, 2010 by applicant.

FIELD

The improvements generally relate to the field of plastic containers, and more particularly to tamper-evidence and leak proof characteristics thereof.

BACKGROUND

It is well known to use plastic containers to sell many types of goods. For instance, it is commonplace in the art that goods such as food or fasteners be provided in plastic containers.

Such plastic containers can be made of various types of plastics, and can be made by thermoforming or injection, for instance.

For the purchaser of such goods to feel confident about the purchase, various means to prevent tampering with the goods have been presented in the past. Some of these deal with making the container more difficult to open, such as requiring a tool for instance. Another approach has been to design the container in a manner that opening it requires breakage of a component, thereby presenting evidence that the container had been tampered with. Although many different designs were presented in the past, many of which were satisfactory to a certain degree, there still remained room for improvement.

Furthermore, for containing liquids, there remained room for improved containers having a satisfactory seal formed between the lid and the receptacle.

SUMMARY

In accordance with one aspect, there is provided a plastic container having a lid and a receptacle, the receptacle and lid having corresponding engagement portions matingly shaped for the lid and receptacle to be maintained in a closed configuration by a resilient effect, the lid having a handle lip extending vertically downwardly from a horizontal edge of the lid, the handle lip being shaped to allow overcoming the resilient effect when manually pulled upwardly; the receptacle having a barrier strip covering the handle lip and preventing manual pulling access thereto, but being tearable to allow its manual removal.

In accordance with another aspect, there is provided a plastic container comprising: a lid having a lid rim, a handle lip extending downwardly from an outer side of the lid rim and having a free lower end, a closure parallel to and downwardly offset from the lid rim, and a lid wall upwardly connecting a periphery of the closure to an inner side of the lid rim, the lid wall having an outwardly protruding rib; a receptacle having a receptacle rim, a receptacle wall portion extending downwardly from an inner side of the receptacle rim, the receptacle wall portion having an inwardly protruding portion shaped to resiliently trap the rib of the lid below it, and a tearable barrier strip detachably connected to the receptacle rim and being shaped as an elongated U to house the handle lip and prevent manual access to at least the free lower end thereof; whereby the lid is manually openable only after the barrier strip has been teared away to provide manual access to the handle lip.

In accordance with another aspect, there is provided a plastic container comprising: a lid having a lid rim, a closure parallel to and downwardly offset from the lid rim, and a lid wall upwardly connecting a periphery of the closure to an inner side of the lid rim, the lid wall having an outwardly protruding rib; a receptacle having an upwardly protruding receptacle rib providing sealing abutment support to the lid closure, a gutter surrounding the receptacle rib, and a receptacle wall portion projecting upwardly from an outer side of the gutter, the receptacle wall portion having an engagement portion matingly shaped to resiliently receive the outwardly protruding rib of the lid and inclined so as to face both inwardly and downwardly in a manner to further exert upon the outwardly protruding rib a sealing force which presses the lid closure against the receptacle rib.

DESCRIPTION OF THE FIGURES

In the figures.

DETAILED DESCRIPTION

Figure 1:
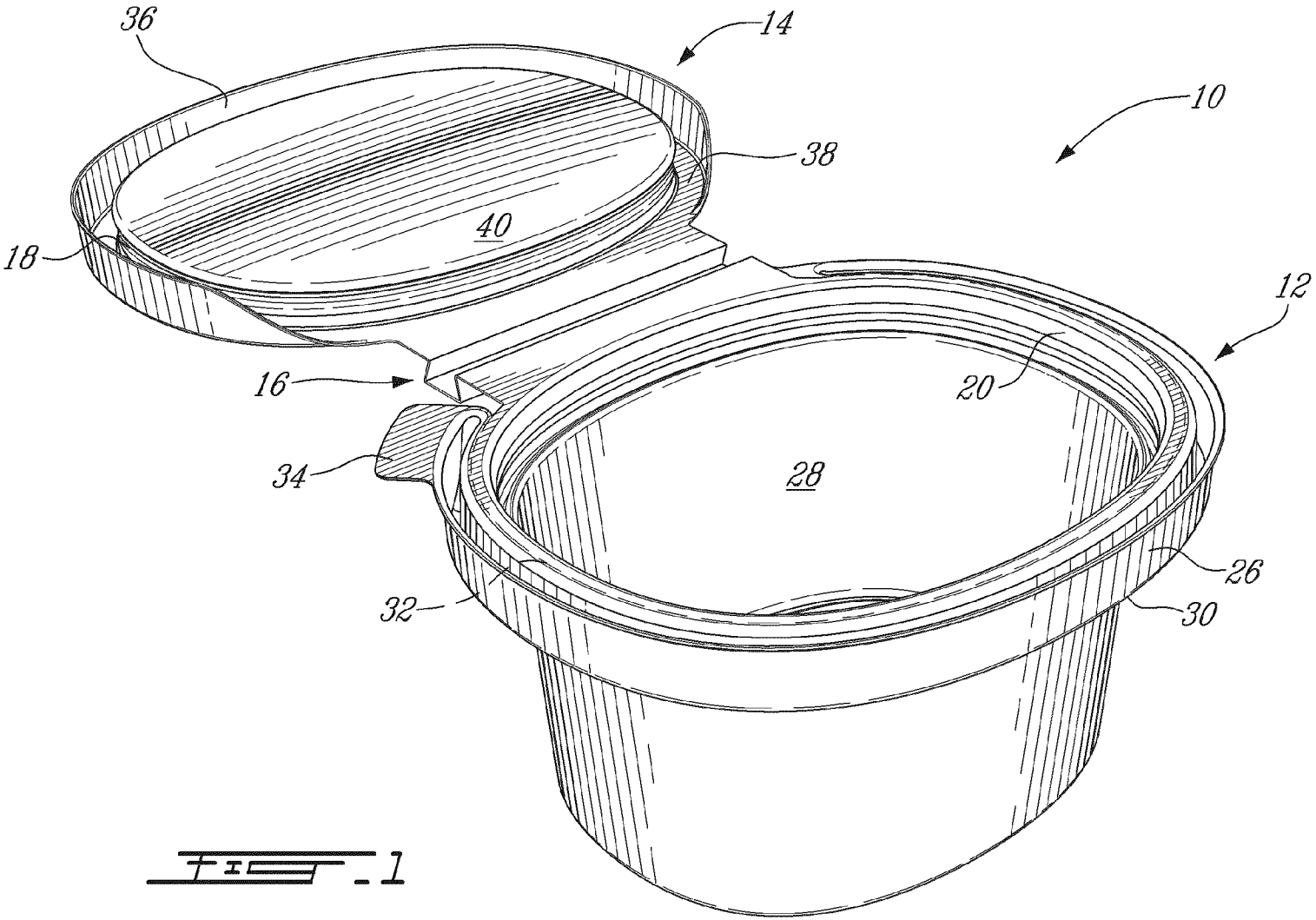
FIG. 1 is a perspective view of an embodiment of a plastic container.

FIG. 1 shows an embodiment of a plastic container 10. The plastic container 10 can be seen to be generally comprised of a receptacle 12 and a lid 14, both of which are made of a thin sheet of plastic. It will be understood by those skilled in the art that an embodiment such as shown or similar can be realised by thermoforming or injection moulding from a wide variety of plastics, for example. In this particular embodiment, the plastic container 10 is thermoformed and the lid 14 is connected to the receptacle by a hinge 16. Further, this particular embodiment is designed to be stackable in either one of the closed and open configurations as can be appreciated from the illustration.

More particularly, still referring to the embodiment shown in FIG. 1, the inner wall 18 of the lid 14 and the upper internal portion 20 of the receptacle 12 are provided with mating engagement portions (22, 24—FIG. 3) which are resiliently engaged with one another when the lid 14 is closed on the receptacle 12 and thereafter maintained in engagement by a resilient effect due to the shape of the plastic container and the elasticity of the material it is made of. This will be detailed further below with reference to FIGS. 4A to 4B.

The receptacle 12 has a barrier strip 26 which surrounds the entirety, or quasi-entirety of the cavity 28 to the exception of the hinge 16. The barrier strip 26 has a U-shaped channel 30, better seen on FIG. 3, and is independent from the engagement portion 24 of the receptacle 12 (i.e. it has no part in the resilient effect which maintains the lid 14 engaged with the receptacle 12 once closed). The barrier strip 26 is detachable from the remainder of the receptacle 12 by tearing along a tear line 32, and one tab 34 or more can be provided to help holding the barrier strip 26 when detaching it from the remainder of the receptacle 12. The lid 14, on the other hand, has a handle lip 36 which projects substantially normally from the lid rim 38, in the same direction than the lid closure 40 also projects from the lid rim 38.

Figure 2A:
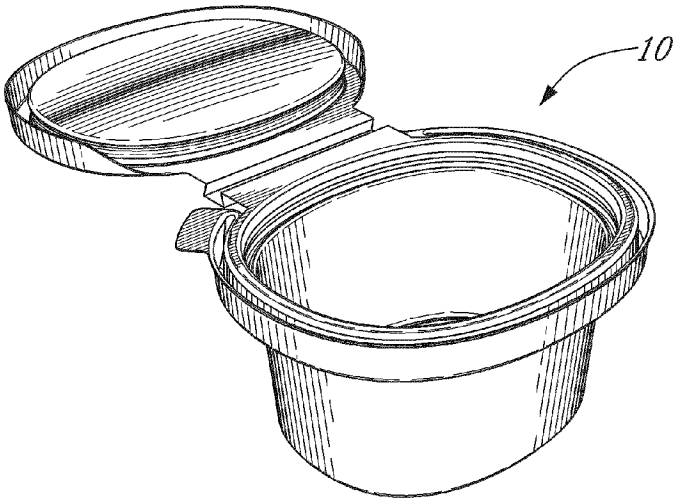
FIG. 2A to 2D are successive views showing closing and opening of the plastic container of FIG. 1.
Figure 2B:
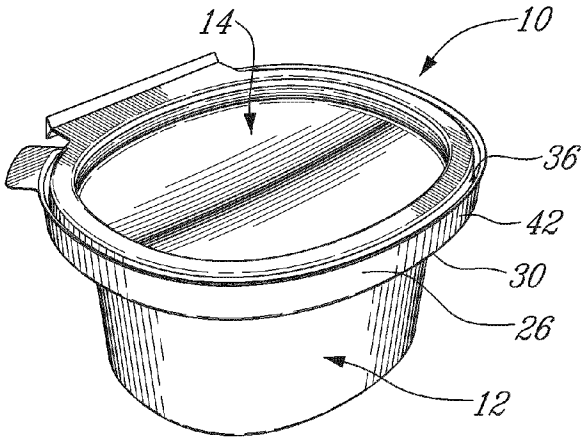

Turning to FIG. 2B, it can be appreciated that the plastic container 10 is configured in a manner that the handle lip 38 is effectively nested in the U-shaped channel 30 of the barrier strip 26 when the lid 14 is engaged with the receptacle 12. In this configuration, an average person cannot reach the free lower end of the handle lip 38 of the lid 14 with his/her fingers because the opening between the handle lip 38 and the outer wall 42 of the barrier strip 26 is too small. An average person therefore finds no grip to open the lid 14. The lid 14 is thus prevented from being manually opened from the closed position by the combination of the resilient effect of the engagement (22, 24—FIG. 3) portions and the barrier strip. To restore manual access to the handle lip 36, the barrier strip 26 must be at least partially detached (i.e. torn along the tear line 32—FIG. 1), which leaves irreversible evidence of tampering.

Figure 2C:
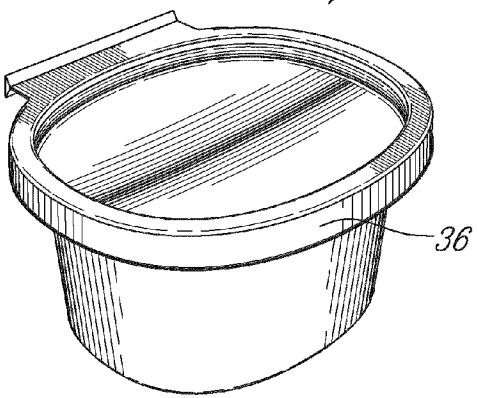
Figure 2D:
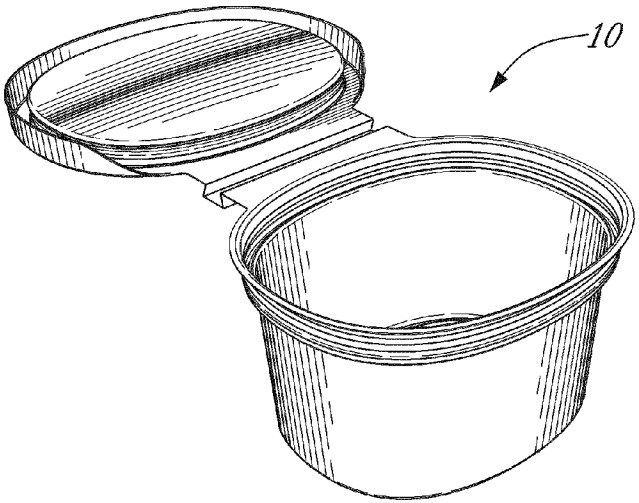
Figure 4A:
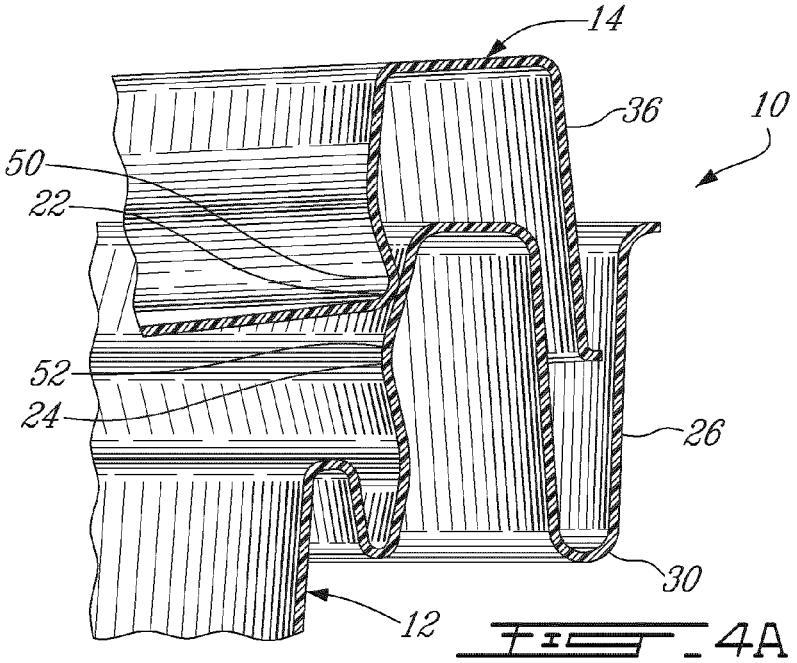
FIG. 4A to 4C are enlarged cross-sectional views corresponding to FIGS. 2A to 2C, respectively.

Turning to FIG. 2C, once a consumer purchases the goods with the plastic container 10, the consumer can remove the barrier strip 26 in one easy step, thereby freeing the handle lip 36 from the barrier. The plastic container 10 can then be easily manually opened into the configuration shown in FIG. 2D by pulling the handle lip 36 upwardly. It will be appreciated by those skilled in the art that the embodiment shown in the attached figures can thereafter be opened and closed more than once by the purchaser, and further offers a highly practical and easy grip due to the fact that the handle lip 36 projects vertically downwardly and does so along a significant distance. Furthermore, there is a convenient finger spacing 44 provided behind the handle lip 36. These latter features are visible more clearly on FIG. 4C.

Figure 3:
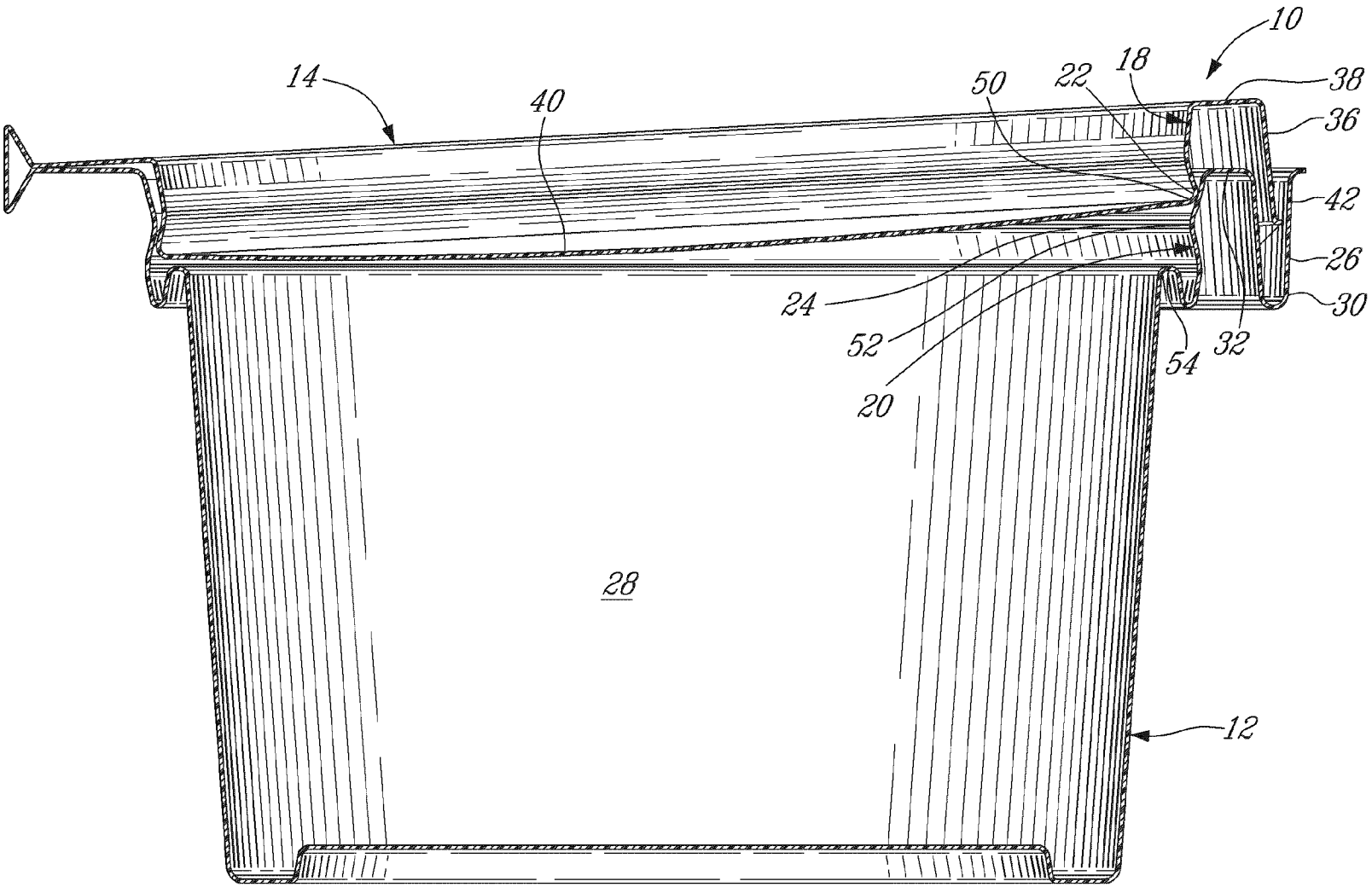
FIG. 3 is a cross-sectional view of the plastic container of FIG. 1.

Turning now to FIG. 3, the details of the engagement portions 22, 24 which serve to cause the resilient effect which maintains the lid 14 closed against the receptacle 14 independently of the eventual removal of the barrier strip 26 are shown in greater detail. In fact, it will be seen in the details of this particular embodiment that the closure 40 of the lid 14 is parallel to the rim 38 of the lid 14, but downwardly projects therefrom and is thus offset. The quasi-annular lid wall 18 which vertically interconnects the periphery of the lid closure 40 to the lid rim 38 is formed with a correspondingly quasi-annularly shaped outwardly protruding bulge referred to herein as an annular or peripheral engagement rib 50. The lid closure 40 itself in this embodiment is relatively flat, but it nonetheless defines a slight camber oriented in the direction of the cavity 28, the purpose of which will be detailed below.

Looking now more particularly at the receptacle 12, and still referring to FIG. 3, it can be appreciated that the upper wall portion 20 of the receptacle also has a quasi-annular bulge or engagement rib 52, but which protrudes inwardly. The expression annular or quasi annular are used herein to refer to the fact that the given features surround the container 10, independently of whether the container 10 is circular or not. It will be understood that the particular configuration of which is to be designed given the elasticity of the material(s) used, in a manner that the inwardly protruding engagement rib 52 of the receptacle 12 normally interferes with the shape and dimension of the rib 50 in the lid, but that at least one of the two components will resiliently yield to allow the rib 50 in the lid 14 to penetrate into the area underneath the inwardly protruding rib 52 of the receptacle wall portion 20 in a somewhat snapping resilient effect. This action can be seen more clearly by referring successively to FIG. 4A and FIG. 4B.

Figure 4B:
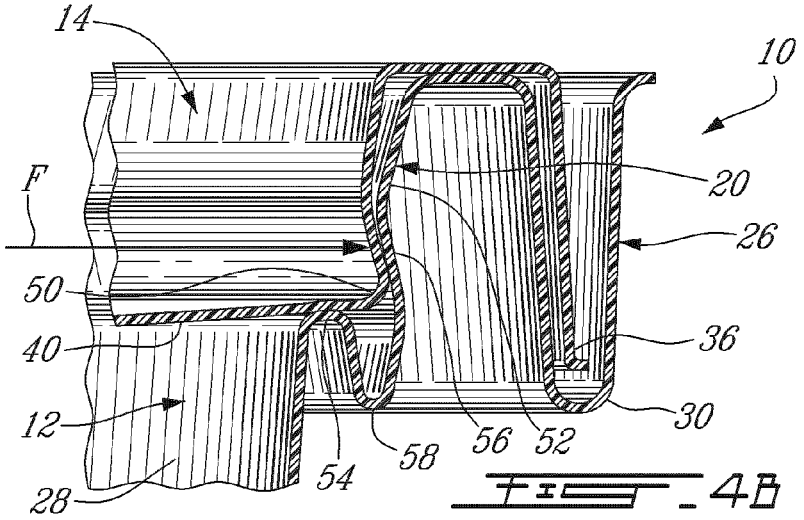
Figure 4C:
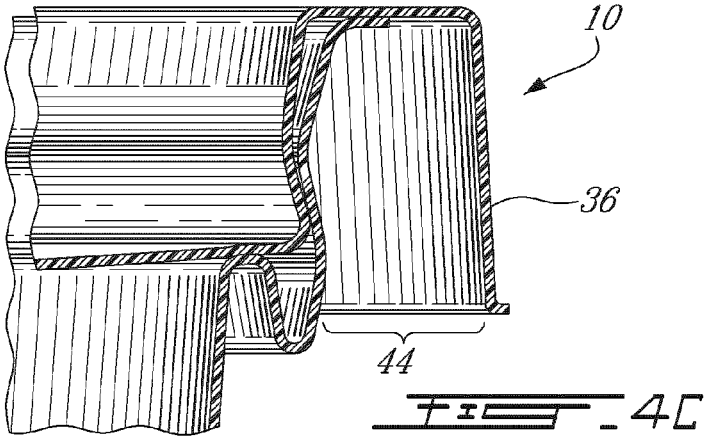

As shown in FIG. 4B, once the lid 14 has been forced into the closed position, the lid 14, and more particularly the closure 40 thereof, comes into abutment with an upwardly-oriented peripheral abutment 54 provided as part of the receptacle 12. At this point, the rib 50 of the lid 14 is pressed against an engagement portion 56 of the receptacle wall portion 20 which is inclined so as to face both inwardly and downwardly. The force F exerted between the engagement portion 56 and the lid rib 50 thus both maintains the lid rib 50 pressed against the engagement portion 56, but the vertical portion of the reaction to this force F also maintains the closure 40 pressed against the abutment 54. In this particular configuration, the fact that the closure 40 is cambered contributes to this resilient effect and creation of the force F. Further, because the closure is cambered toward the cavity 28, a pressure increase occurring in the cavity upon closing the lid will act against the closure 40, tend to press upwardly against the camber and thus further push the annular lid rib 50 against the engagement portion 56 of the receptacle 12, and thereby strengthen the lock and seal. A pressure increase typically occurs for instance as the lid is pushed closed against the receptacle, but can also occur in other circumstances, such as if liquid is shaken in the container, for instance. It will be noted here that in this particular embodiment, a gutter shaped member, or gutter 58, is provided between the peripheral abutment 54 and the engagement portion 56. It will be noted that the gutter is free from interference with the lid 14, and that it can contribute to the resilient effect by acting in the manner of a spring biasing the engagement portion 56 inwardly. A form of spring can thus be said to be formed in the receptacle portion 12 by the "S" shape formed by the combination of the peripheral abutment 54 and the gutter 58, given the elasticity of the plastic material, and a form of spring is formed in the lid portion with the camber in the closure 40, the two springs working together to lock the lid in the closed position and form an effective seal.

In certain applications where fluid matter is to be contained in the container 10, it is desirable that an effective seal be provided between lid 14 and the receptacle 12 to prevent or at least limit the evacuation of fluid between the lid 14 and receptacle 12. Positioning a rib made of the resilient plastic material in a manner that it be maintained in pressing contact with a flatter surface can allow to achieve a satisfactory seal in certain applications. In the particular configuration illustrated, the plastic container is designed with two distinct features where this occurs: firstly where the peripheral abutment 54 forming a rib is maintained pressed against the flatter surface of the closure 40, and secondly, where the lid rib 50 is maintained pressed against the engagement portion 56 of the receptacle 12. Both of these features can thus be designed to form an independent seal along the entire periphery of the container. The presence of two distinct seals, separated here by the gutter 58 for instance, can increase the sealing efficiency. Further, the efficiency of the seal can also be affected by the radius of the rib. The peripheral abutment 54 of the receptacle 12 can thus be referred to as the sealing rib of the receptacle 12, whereas the peripheral rib 50 of the lid 14 acts as a sealing rib of the lid 14. It will be understood that the presence of a gutter 58 is optional, and that if used, it can be oriented otherwise than downwardly in alternate embodiments, such as laterally for instance.

It will be understood that the embodiment described herein and illustrated are provided for illustrative purposes only and that the improvements can be embodied in a wide variety of alternate embodiments or realizations. For instance, alternate embodiments can include plastic containers made with injection moulding, plastic containers having distinct/unconnected lid and receptacle, plastic containers not intended to be leak-resistant, or plastic containers without tamper-evident features. Where present, the hinge can alternately consist of a simple fold, for instance. Although the depicted container has an oval horizontal cross-section, it can have other closed curved shape, ranging from closer to a circle, to closer to a rectangle but without sharp corners, for instance. The wall portion, rims, ribs, handle lip and barrier strip can be shaped to correspond with the alternate shape of the horizontal cross-section. Further, it is to be understood that the expressions up and down, vertical and horizontal, etc. are used herein for convenience and typically refer to the container when it is laid flat on a horizontal surface. The expressions inwardly/outwardly refer to the inside of the container, and often refer to a horizontal or vertical orientation relative to the inside of the container. The expression vertical in particular must be interpreted with some breadth as encompassing features which are close to vertical. The expression oval can be interpreted rather loosely and can include an ellipse. It will also be understood that reference is often made to the container in its closed configuration to discuss sealing, engaging, and tamper-evident features, for instance. This thorough description provided for the convenience of the skilled reader is thus not intended to be interpreted in an unduly restrictive manner.

As can be seen therefore, the examples described above and illustrated are intended to be exemplary only. The scope is indicated by the appended claims.

What is claimed is:

1. A plastic container comprising:

a lid having a lid rim, a handle lip extending downwardly from an outer side of the lid rim and having a free lower end, a closure parallel to and downwardly offset from the lid rim, and a lid wall upwardly connecting a periphery of the closure to an inner side of the lid rim, the lid wall having an outwardly protruding rib;

a receptacle having a receptacle rim, a receptacle wall portion extending downwardly from an inner side of the receptacle rim, an upwardly protruding receptacle rib providing abutment support to the lid closure, and a gutter surrounding the receptacle rib, the receptacle wall portion projecting upwardly from an outer side of the gutter and having an inwardly protruding portion shaped to resiliently trap the rib of the lid below it, a tearable barrier strip detachably connected to the receptacle rim and being shaped as an elongated U to house the handle lip and prevent manual access to at least the free lower end thereof, and an engagement portion inclined so as to face both inwardly and downwardly in a manner to further exert upon the outwardly protruding rib a sealing force which presses the lid closure against the receptacle rib;

whereby the lid is manually openable only after the barrier strip has been teared away to provide manual access to the handle lip.

2. The plastic container of claim 1 wherein the barrier strip is detachable along a tear-line extending along the receptacle rim.

3. The plastic container of claim 1 further comprising a finger spacing between the handle lip and the receptacle wall portion.

4. The plastic container of claim 1 wherein the free lower end of the handle lip projects downwardly past a height of the lid rim.

5. The plastic container of claim 1 wherein the handle lip is horizontally aligned with and outwardly offset from the receptacle wall portion.

6. The plastic container of claim 1 wherein the receptacle is connected to the lid by a hinge.

7. The plastic container of claim 6 wherein the hinge includes a horizontal projection of the lid rim and of the receptacle rim.

8. The plastic container of claim 6 wherein the barrier strip surrounds the receptacle with the exception of the hinge.

9. The plastic container of claim 6 wherein the barrier strip extends along an entire curved front of the container, opposite the hinge, and exceeds the entire curved front along opposite curved sides of the container.

10. The plastic container of claim 6 wherein the receptacle wall portion, the rib, the lid rim and the receptacle rim have a horizontal cross-section which has a curved closed shape.

11. A plastic container comprising a lid and a receptacle, the receptacle and the lid having corresponding engagement portions matingly shaped for the lid and the receptacle to be maintained in a closed configuration by a resilient effect, the lid having a closure, a lid wall extending upwardly from an outer end of the closure and including an outwardly protruding rib, a rim parallel to and upwardly offset from the closure and extending outwardly from an upper end of the lid wall, and a handle lip extending vertically downwardly from a horizontal edge of the lid;

the receptacle having a detachable barrier strip covering the handle lip and preventing manual pulling access thereto; the receptacle having a receptacle rim, a receptacle wall portion extending downwardly from an inner side of the receptacle rim, an upwardly protruding receptacle rib providing abutment support to the lid closure, and a gutter surrounding the receptacle rib, wherein the receptacle wall portion projects upwardly from an outer side of the gutter, the receptacle wall portion having an inwardly protruding portion shaped to resiliently trap the outwardly protruding rib of the lid below it and an engagement portion inclined so as to face both inwardly and downwardly in a manner to further exert upon the outwardly protruding rib a sealing force which presses the lid closure against the receptacle rib.

12. The plastic container of claim 11 wherein the barrier strip is shaped as an elongated U and nestingly receives the handle lip when the lid is closed.

13. The plastic container of claim 11 wherein a free lower end of the handle lip projects downwardly past a height of the engagement portions.

14. The plastic container of claim 11 wherein the receptacle is connected to the lid by a hinge.

15. The plastic container of claim 14 wherein the barrier strip surrounds the receptacle with the exception of the hinge.

16. A plastic container comprising:

a lid having a lid rim, a closure parallel to and downwardly offset from the lid rim, and a lid wail upwardly connecting a periphery of the closure to an inner side of the lid rim, the lid wall having an outwardly protruding rib; and a receptacle having an upwardly protruding receptacle rib providing sealing abutment support to the lid closure, a gutter surrounding the receptacle rib, and a receptacle wall portion projecting upwardly from an outer side of the gutter, the receptacle wall portion having an inwardly protruding engagement portion matingly shaped to resiliently receive the outwardly protruding rib of the lid below it and inclined so as to face both inwardly and downwardly in a manner to further exert upon the outwardly protruding rib a sealing force which presses the lid closure against the receptacle rib.

17. The plastic container of claim 16 wherein both the receptacle rib and the lid rib have a curvature which is more pronounced than a curvature of the surface against which they abut.

18. The plastic container of claim 16 wherein the gutter projects downwardly.

19. The plastic container of claim 16 wherein the closure is cambered inwardly.

* * * * *